US005088975A

United States Patent [19]

Ghilardi

[11] Patent Number: 5,088,975

[45] Date of Patent: Feb. 18, 1992

[54] APPARATUS FOR THE PRODUCTION OF PAPER NAPKINS AND SIMILAR PRODUCTS

[75] Inventor: Mauro Ghilardi, Lucca, Italy

[73] Assignee: Pablo Perini S.p.A., Lucca, Italy

[21] Appl. No.: 536,155

[22] Filed: Jun. 7, 1990

[30] Foreign Application Priority Data

Jun. 8, 1989 [IT] Italy ..... 9449 A/89

[51] Int. Cl.[5] ..... B65H 45/08

[52] U.S. Cl. ..... 493/359; 493/440; 493/443; 493/456; 270/41

[58] Field of Search ..... 270/47, 40, 41, 42, 270/43; 493/356, 358, 359, 360, 442, 443, 446, 447, 439, 440, 455, 456

[56] References Cited

U.S. PATENT DOCUMENTS

| | | | |
|---|---|---|---|
| 673,312 | 4/1901 | Bechman | 493/359 |
| 879,443 | 2/1908 | Cottrell | 493/439 |
| 2,070,394 | 2/1937 | Danger | 270/41 |
| 4,190,242 | 2/1980 | Bolza-Schunemann | 270/42 X |
| 4,349,185 | 9/1982 | Small et al. | 270/42 X |
| 4,421,501 | 12/1983 | Scheffer | 493/456 X |
| 4,901,993 | 2/1990 | Hänch | 493/456 X |
| 4,921,235 | 5/1990 | Biagiotti et al. | 270/47 |

FOREIGN PATENT DOCUMENTS

| | | | |
|---|---|---|---|
| 2853741 | 7/1980 | Fed. Rep. of Germany | 493/359 |
| 2061233 | 5/1981 | United Kingdom | 493/358 |

*Primary Examiner*—William E. Terrell
*Assistant Examiner*—John A. Marlott
*Attorney, Agent, or Firm*—Francis J. Bouda

[57] ABSTRACT

The apparatus for the production of paper napkins or other similar products which includes a feeder for continuously supplying a web of material, a slitter for cutting the web into a plurality of longitudinal strips, a first folder to fold the strips lengthwise, a transverse cutter for providing lengths of longitudinally folded strips, a second folder to fold the strips transversely, and a stacker to pile up the finished napkins. A driving roller matches the two edges of the longitudinally folded strips and downstream of the driving roller are inclined surfaces to separate the longitudinally folded strips to lay them down on a common geometric plane parallel to each other.

13 Claims, 5 Drawing Sheets 18
20
S1
22
S4
S
S2
T
L
24
12
7
N
14
16
9
fN
III
II

Fig. 5
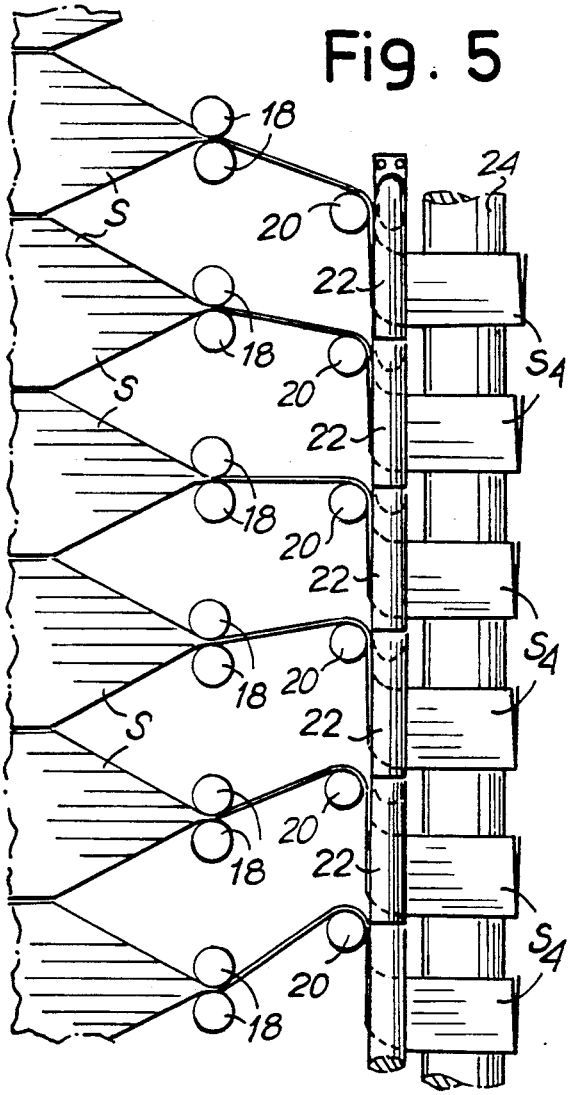
Fig. 6
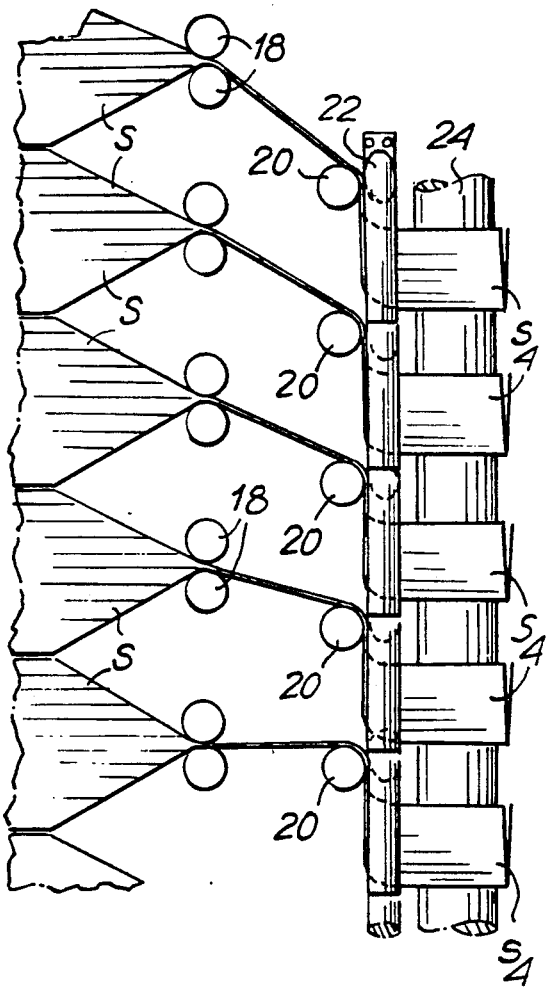
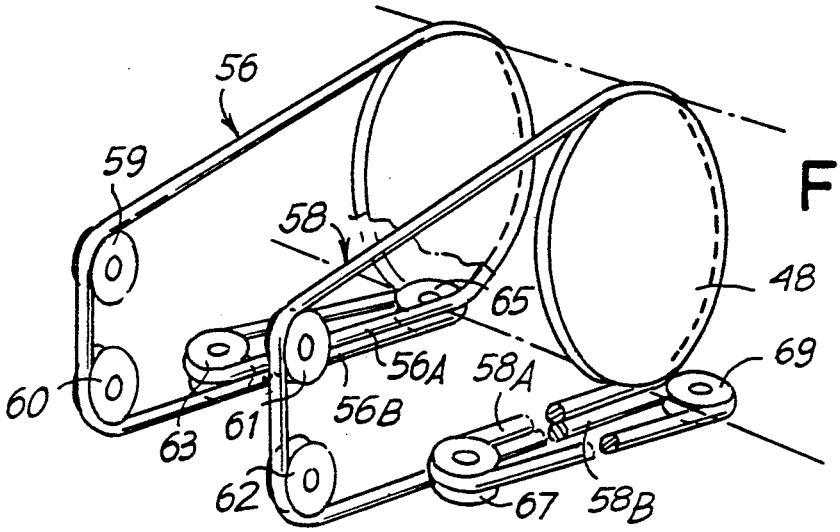
Fig. 7

APPARATUS FOR THE PRODUCTION OF PAPER NAPKINS AND SIMILAR PRODUCTS

BACKGROUND OF THE INVENTION

It is well known in the art of making, folding, stacking, and packaging paper webs such as table napkins (serviettes), facial tissues and the like, that it is desirable to fold the web longitudinally to create a first "half fold", and thereafter to fold the web one or more times transversely with regard to the first fold-line to create a "quarter-fold" or "third-fold" or the like, ready for packaging in individual cartons or in bulk packages for institutional dispensers or the like.

The use of a folding pan to create the first longitudinal fold is well-known and, although included as a first step in this apparatus, needs no detailed description.

The subsequent transverse folds to create the one-half or one-third folds is more complicated, and has been the subject of many disclosures such as those shown in various U.S. patents, especially those classified by the U.S. Patent System in Class 270 (Sheet-Material Associating) and particularly Sub-Classes 32 to 51.

SUMMARY OF THE INVENTION

The present invention refers to an apparatus for the manufacturing of paper napkins or other similar articles from a continuous web of undetermined length. The web is slit into strips and triangle-shaped pans fold the strips lengthwise. Thereafter, the folded strip is cut into stretches which are then folded transversely, and subsequently piled up in successive stacks of manufactured articles.

Machines of such type are known in which a paper web of relatively limited width is longitudinally subdivided into a limited number of strips for the production of napkins. The strips obtained from the longitudinal cut of the web are folded longitudinally and moved in a direction substantially perpendicular to the web feeding direction in order to be cut transversely and folded a second time. These prior art machines have several drawbacks, among which is the limitation to use relatively narrow webs. This means that the associated machinery must also be narrow. Such associated machines differ from those used for the handling of wide webs, for example, in winders and re-winders for the production of logs or rolls of toilet paper, kitchen towels, all-purpose wipers, and the like. Moreover, the special configuration of these prior machines obliges the strips to travel along paths of different lengths. This results in more or less marked irregularities in the final product. Furthermore, as the folded strips move at an angle to the web feeding direction, these earlier machines generally result in production lines of larger overall dimensions.

The object of the invention is to provide a machine for the production of napkins and the like which does not have the drawbacks present in the known machines and, in particular, those set forth above.

Accordingly, the machine of the present invention includes means for cutting the web into a plurality of longitudinal strips having a width corresponding to that of the articles to be produced. For each strip there is a folding pan for longitudinally folding the relevant strip. Downstream of each of said folding pans, driving rollers match the two edges of longitudinally folded strips. Downstream of said driving rollers, inclined profiles move the longitudinally folded strips to lay them down onto a common geometric plane in parallel relationship to each other. Thereafter, well-known means cut the strips into stretches, fold said stretches transversely, and pile up the products in stacks.

By using the inclined profiles, there is obtained a machine in which the longitudinally folded strips move forward along parallel and coplanar trajectories substantially parallel to the web feeding direction. The cutting and transverse folding groups for the strip may thus be aligned and, moreover, may also be uniformly spaced from the longitudinal folding means, even along a wide front. This allows very wide parent rolls of web material to be used.

In one embodiment, for each strip the driving rollers comprise two rollers disposed side-by-side and close to each other to receive and match the edges of the relevant longitudinally folded strip.

To offset each folded strip in such a way that on the exit of said strip from the relevant inclined profile its center line is coplanar to the center line of the strip before the folding, a further driving roller may advantageously be provided for each strip. This roller has its axis parallel to the side-by-side rollers and downstream thereof (with respect to the strip advancement direction) and upstream of the relevant inclined profile.

In practice, downstream of said driving rollers and said inclined profiles, additional roller means are provided having a common axis at a right angle to the axes of the driving rollers to move the strips into a common plane. Said additional roller means may comprise, for example, a single roller extending across the whole width of the work front.

In order to obtain trajectories of equal length for all the strips, in one embodiment of the invention provision may be made for the driving roller means and the inclined profiles relevant to each strip to be equidistant from each other.

According to a modified embodiment of the machine of the invention, when it is desired to reduce the work front by moving the folded strips close to each other, provision may be made for the inclined profiles to be transversely offset by different extents to the relevant means performing the longitudinal folding. When a driving roller is disposed directly upstream of the inclined profile relevant to each strip, the driving rollers of the various strips may also be transversely offset by different amounts to the means performing the longitudinal folding.

The invention refers also to a method for the production of paper napkins or similar products, wherein a web of material of undefined length for the production of said napkins is cut into longitudinal strips; said strips are longitudinally folded; and the folded strips are fed to means for the cutting and the transversal folding.

According to the invention, the method is characterized in that the longitudinally folded strips are moved to lie parallel to each other and coplanar on a plane intersecting the plane of the strips prior to the longitudinal folding along a straight line at a right angle to the web feeding direction.

By this method, it is possible to produce articles such as napkins or the like starting from a web of considerable width and of undetermined length, by cutting this web into a plurality of longitudinal strips. The working may take place in line and with trajectories approximately (or even exactly equal for all the strips).

In another embodiment of the method according to the invention, the longitudinally folded strips are moved transversely so that the center line of each one thereof is coplanar to the center line of the strip prior to the longitudinal folding.

When it is desired to have a narrower work front, with the longitudinally folded strips moved close to each other, the method of the invention provides, in a modified embodiment, that the longitudinally folded strips be transversely offset to each other by variable extents so that the center lines of the longitudinally folded strips will be spaced apart a lesser amount than the distance from the center lines of the strips prior to the longitudinal folding.

With the above and other objects in view, more information and a better understanding of the present invention may be achieved by reference to the following detailed description.

DETAILED DESCRIPTION

For the purpose of illustrating the invention, there is shown in the accompanying drawings a form thereof which is at present preferred, although it is to be understood that the several instrumentalities of which the invention consists can be variously arranged and organized and that the invention is not limited to the precise arrangements and organizations of the instrumentalities as herein shown and described.

In the drawings, wherein like reference characters indicate like parts:

FIGS. 5 and 6 show fragmentary plan views of modified embodiments;

FIG. 7 shows a schematic perspective view of the belt system for the withdrawal of the folded products.

Figures 1, 2, 3:
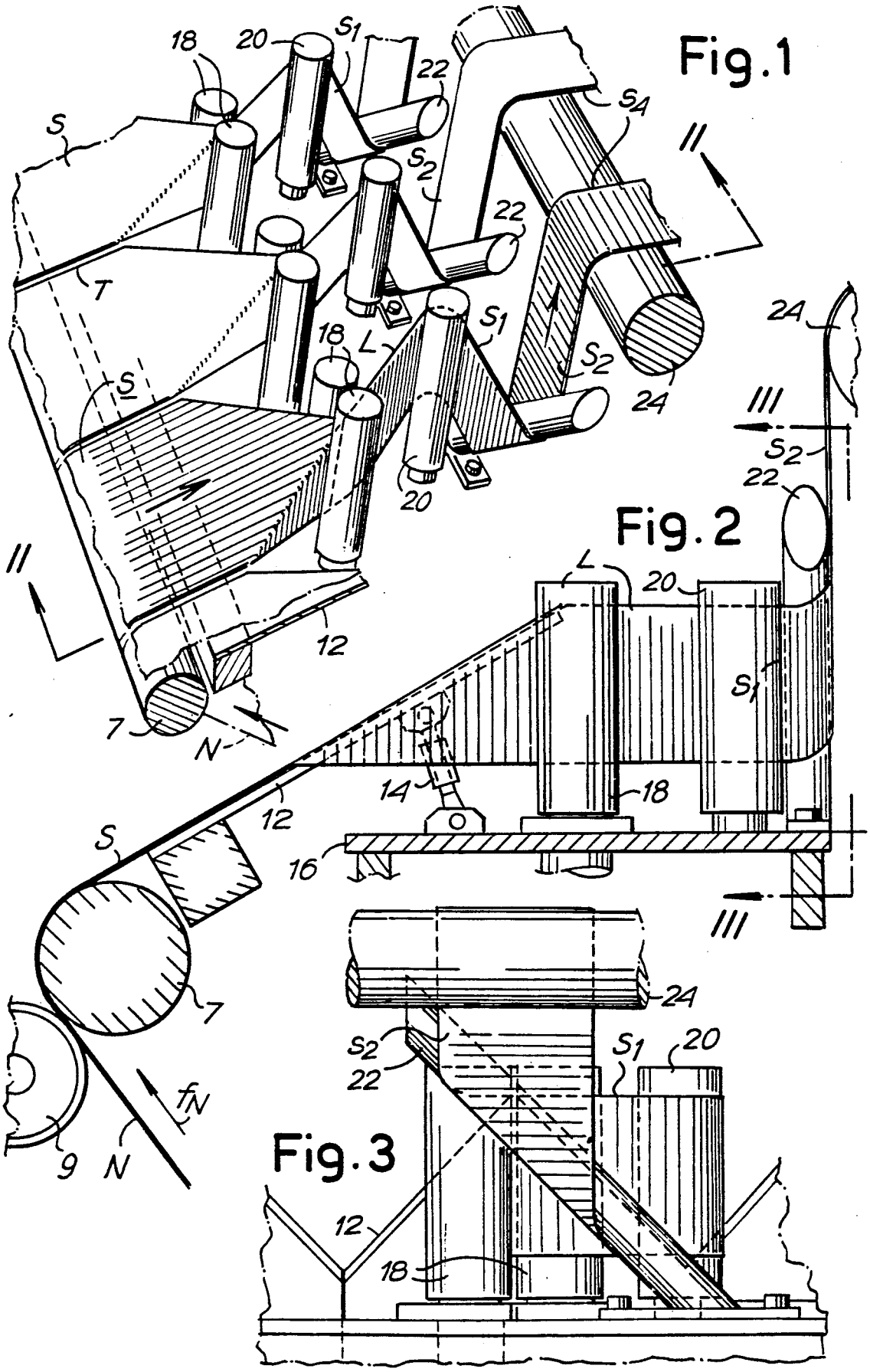
FIG. 1 shows a partial fragmentary perspective view.
FIG. 2 shows a longitudinal section view taken on line II—II of FIG. 1.
FIG. 3 shows a partial view taken on line III—III of FIG. 2.

Referring now to FIGS. 1, 2, 3 and 4, N indicates a paper web of considerable width which is fed according to arrow fN to a preliminary work machine 1, the operative portions of which are indicated in details in FIGS. 1, 2 and 3. Here the web N is cut into strips having width equal to the desired width of the final manufactured article, and continuously longitudinally folded into said strips. Numerals 3, 5 and 7 indicate cylinders for driving the web N.

Cooperating with the driving roller 7 cutting means 9 are provided which perform longitudinal cuts of the web N to form longitudinal strips S which pass from said cylinder 7 onto an inclined surface defined by a plurality of triangle-shaped folding pans 12. Each pan corresponds to one of the strips S and is able, in a well-known manner, to fold the relevant strip S along a longitudinal central folding line L which then defines the two longitudinal edges to be matched. The angle of pans 12 may be adjusted by adjustment screws 14 connected to the assembly supporting structure 16.

The same structure 16 supports, near the peak of each triangle 12, a pair of driving rollers 18 which receive the relevant strip and match the folded edges and press the folding line L. In the illustrated example, a further driving roller 20 is provided downstream of each pair of driving rollers 18, but this further roller 20 is optional.

In the drawing, the axes of rollers 18 and the axes of rollers 20 lie on two parallel and vertical planes, and the said rollers may be driven or rotate freely. As the axes of rollers 20 are coplanar, the folded strips S are moved into a common plane tangent to rollers 20 at a position opposite to that of rollers 18. The portions of the folded strips which are turned by the rollers 20 ar indicated by S1 in FIGS. 1, 2 and 3.

These portions S1 then contact the inclined turning bars 22 which lie parallel to each other and in a plane parallel to that of the axes of rollers 18 and of rollers 20. The angle of the turning bars 22 is such that each of the folded strips is moved from the portion S1, having substantially horizontal development to a trajectory S2 which is vertical and at a right angle to portion S1, as can be seen in FIG. 3.

The strips, folded and turned in the above described manner, reach a further driving roller 24 having horizontal axis, so that the various strips are further moved according to trajectory portions S4 lying in a substantially horizontal plane. Here they leave machine 1 and reach another machine 26, to be described later on, for the handling of folded and coplanar strips S4 for the formation of packs or stacks of napkins or other products obtained from strips S4.

In the embodiment shown in FIGS. 1 to 3, all the pairs of rollers 18 are equally spaced from the corresponding triangles 12. The position of the driving rollers 20 and/or the position of the inclined turning bars 22 with respect to triangles 12, can be equal for all the groups as shown in FIGS. 1 to 3. Selectively, however, they may vary in such a way that the strips in the trajectories S2 and S4 may be moved closer to each other instead of being kept spaced apart a distance corresponding to the width of the folded strip (which is what occurs when the relative position of rollers 18 and 20 and turning bars 22 remains equal for all the triangles 12). This arrangement which allows the trajectories of strips S4 to be brought closer, is schematically illustrated in two different embodiments in FIGS. 5 and 6. In these figures, corresponding parts are indicated by the same reference numerals as in FIGS. 1 to 3. This arrangement may be useful for reducing the transverse dimensions of machine 26 or any machines located downstream of the above described machine 1.

In order to reduce friction between turning bars 22 and the web material, the surfaces of said bars may be provided with nozzles or holes through which there is blown pressurized air from inside of the bars 22. The nozzles are placed in the zones of the surfaces of bars 22 on which the web material is made to slide, thus reducing the friction.

Figure 4:
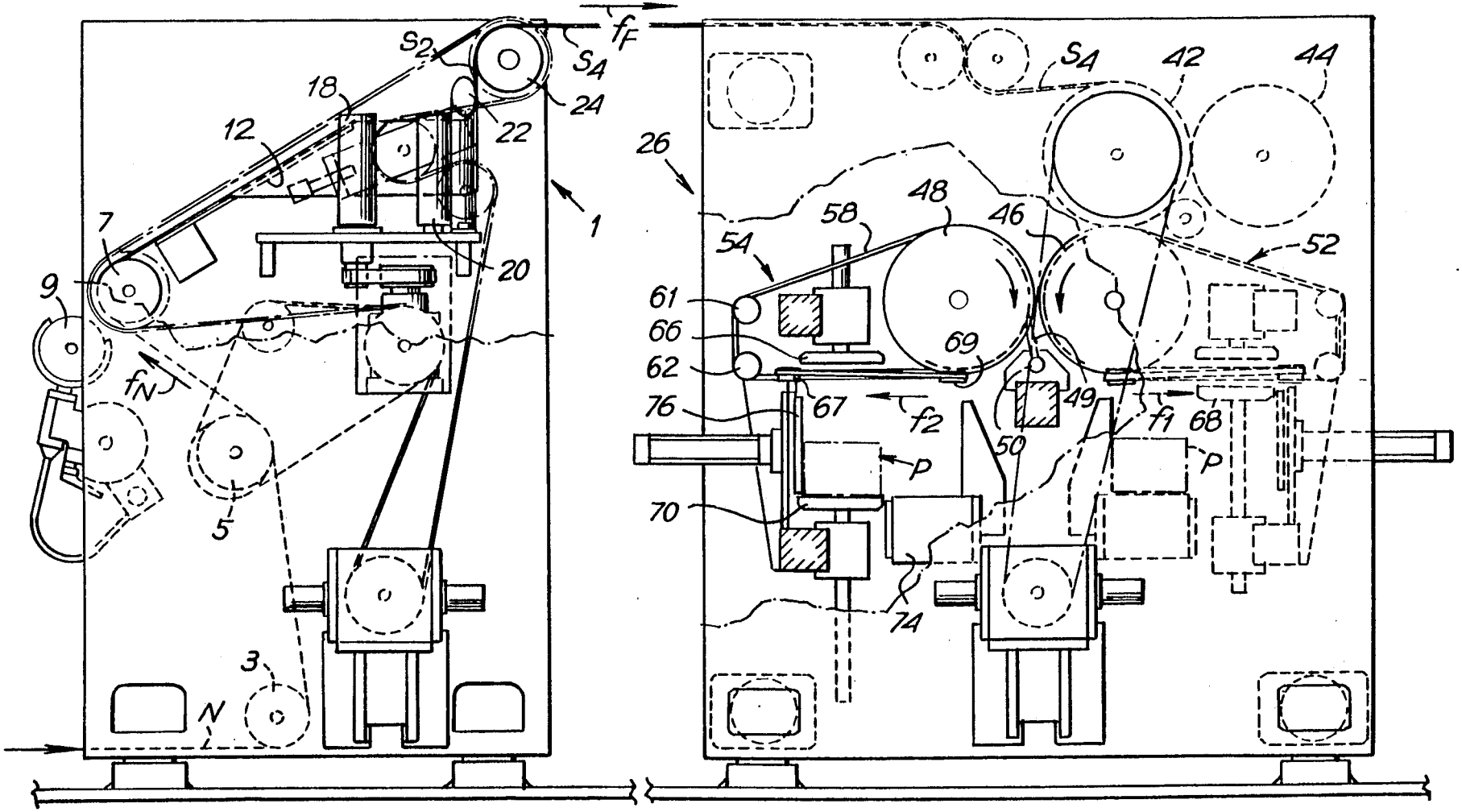
FIG. 4 shows a folding machine of the present invention and also a stacking machine.

The machine 1 has a very compact structure such that the strips S4, formed by longitudinally cutting the web N and longitudinally folded by the triangles 12, leave said machine in a direction substantially parallel with the in-coming direction of web N indicated by fF in FIG. 4.

Unlike prior machines, the machine according to the invention may thus be inserted into a continuous production line and be preceded by embossers or other machines for the working of the web before the longitudinal cutting thereof, and followed, still in line, by the machine 26 for the transverse cut of strips S4 and the folding of the napkins. The in-line arrangement permits the overall size of the work line to be greatly reduced, even when webs N of considerable width produce a large number of strips S. This brings about the further advantage of possibly using, upstream of machine 1, embossing, printing and similar devices already designed for webs of considerable width and usually employed for other products such as rolls of all-purpose wipers, kitchen towels, and the like.

Moreover, as clearly shown in FIGS. 1 to 3, by the present invention, it is possible to make all the strips S travel an equally long path between the folding triangles 12 and the driving rollers 24 at the exit of machine 1. This is particularly important to achieve a uniform result. The travel distance between the roller 24 and the next working group 26 is also the same for all strips S4.

The machine 26, located downstream of the above described machine 1, may be any machine for handling the folded strips for the formation of packages of napkins or other similar articles, for example, machines like those illustrated in U.S. Pat. No. 4,921,235 issued May 1, 1990.

The machine 26, schematically shown in FIG. 4, is provided with a pair of folding and cutting cylinders 42, 44, which receive the strips S4 and which cut these strips in successive pieces of suitable length, for example, the same as the width of strips S. The pieces of strip are continuously fed to a distribution group which comprises a pair of cylinders 46, 48 provided with opposite annular grooves within which the prongs of a comb 49, oscillating about a pivot 50, may travel for the purposes indicated hereinafter.

The pieces of strips S4, upon their transit between the group of cylinders 42, 44 and the cylinder 46, are transversely folded once so that when they reach the zone between cylinders 46 and 48, they are spaced apart one from the other an extent corresponding to half the length of the pieces into which the strips have been cut. By displacing the comb 49 from a position where the prongs are inserted into the grooves of cylinder 48 to an opposite position where the prongs are inserted into the grooves of cylinder 46, there is obtained a change of the flow of the folded pieces, that is to say, of the napkins, to one direction or the other as indicated by arrows f1 and f2, towards stacking groups generally indicated by 52 and 54.

Figure 10:
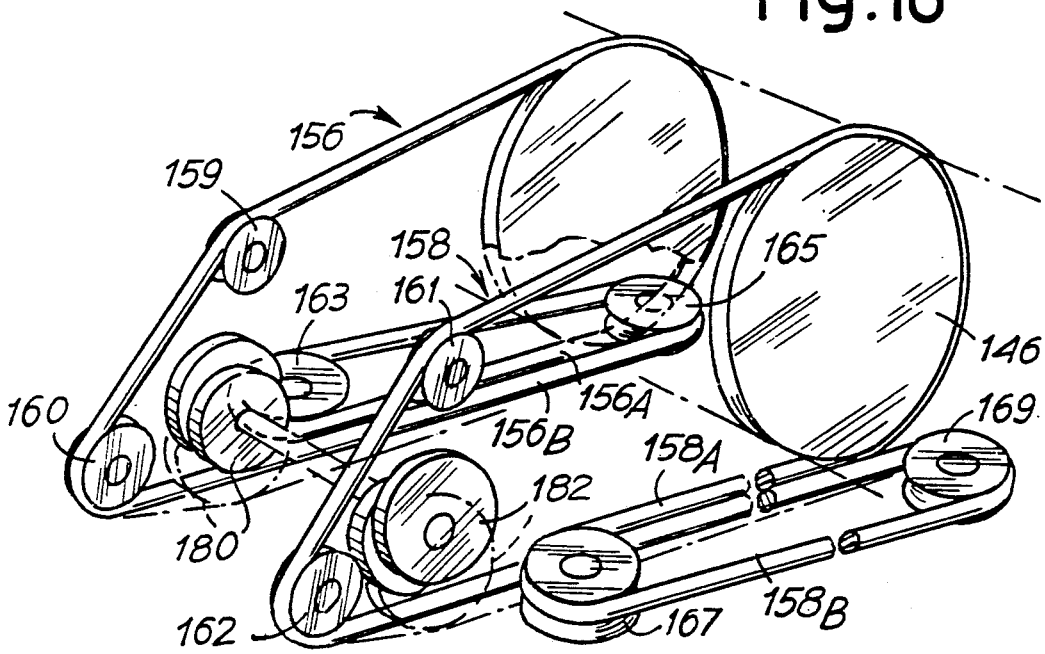
FIG. 10 shows a perspective schematic view similar to FIG. 7 of a modified embodiment of the belt assembly for picking up the folded articles.

The transfer of the napkins may take place by engagement of their longitudinal edges with pairs of belts having circular cross-section (See FIGS. 7 and 10).

For each stacking group, two belts are provided disposed as shown schematically in FIG. 7. Around the cylinder 48, two belts 56, 58 are driven, one of which (58) is shown in FIG. 4. Each belt is driven around pulleys 59, 60, 61, 62 having horizontal axes and around pulleys 63, 65, 67, 69 having vertical axes. Thereby, the two branches 56A, 56B and 58A, 58B respectively of each belt 56, 58 will be parallel and disposed side-by-side to grip the edges of the folded napkins. The disposition schematically illustrated in FIG. 4 is symmetrically repeated for the two stacking groups 52, 54.

The napkins are transferred by the belts 56, 58 below the pushing pads 64 and 66, the lowering of which causes the napkins to withdraw from the side-by-side disposed branches 58A, 58B and 56A, 56B of belts 56, 58 of one or the other of groups 52, 54 respectively, to be placed on a shelf 68 or 70 respectively. Each shelf 68 and 70 is progressively lowered with the increase of the thickness of pack P of napkins being stacked thereon. When a pack P has reached the desired thickness or the desired number of napkins, the comb 49 moves to direct the napkins' flow towards the other stacking group.

The completed stack of napkins is now fully lowered by a lowering of the relevant shelf, as indicated for the shelf 70 on the left side of FIG. 4. Under these conditions, the shelf 70 is at the level of a belt conveyor 74 (near the shelf 70) so that the napkins stack P can be transferred by a pusher means 76 from shelf 70 to conveyor 74. This provides for the removal thereof from the stacking region. At this point, the shelf 70 will rise to be ready to receive a new set of napkins forming a new stack of napkins.

Figure 8:
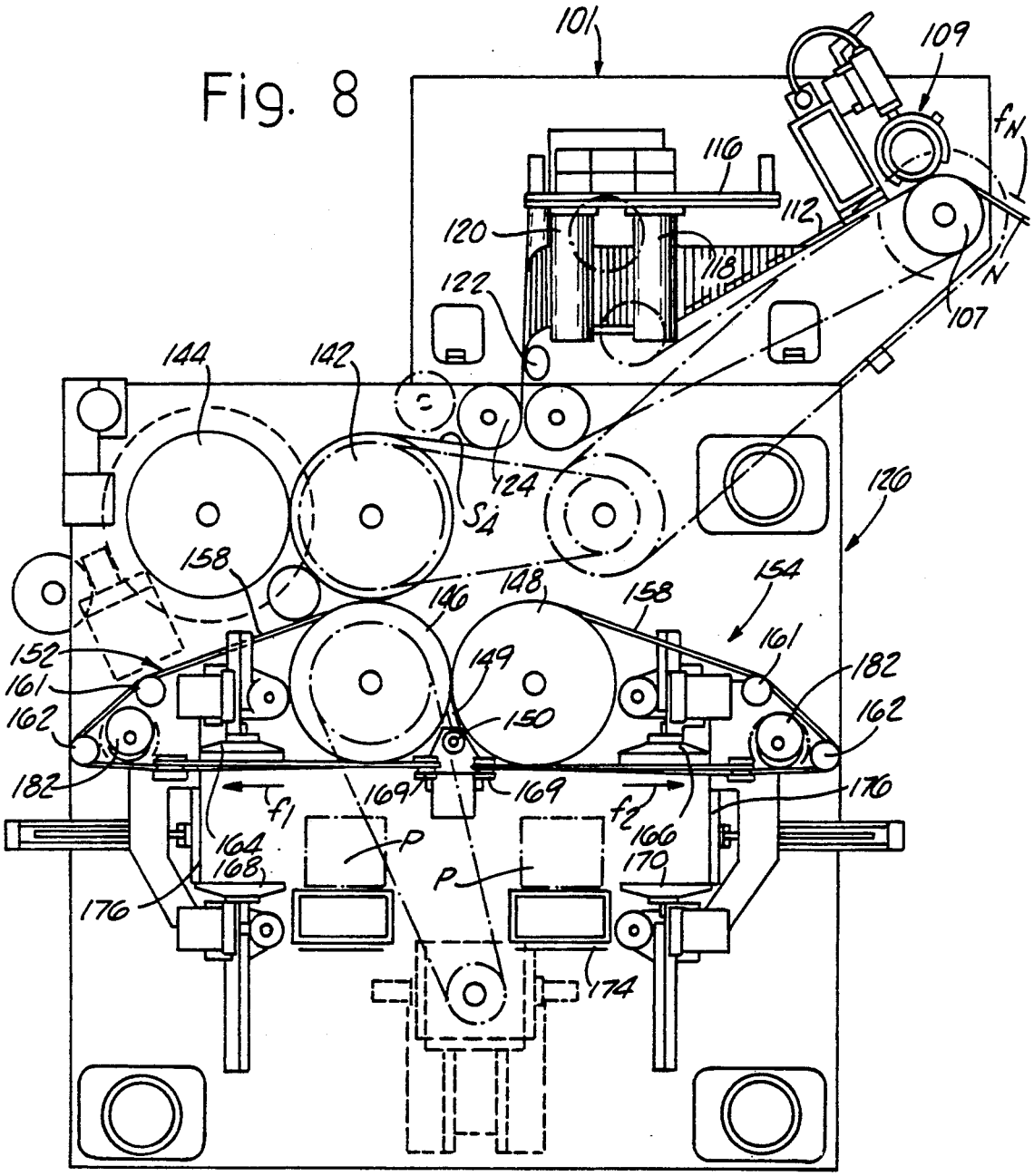
FIG. 8 shows a side view of a modified embodiment similar to the view of FIG. 4.
Figure 9:
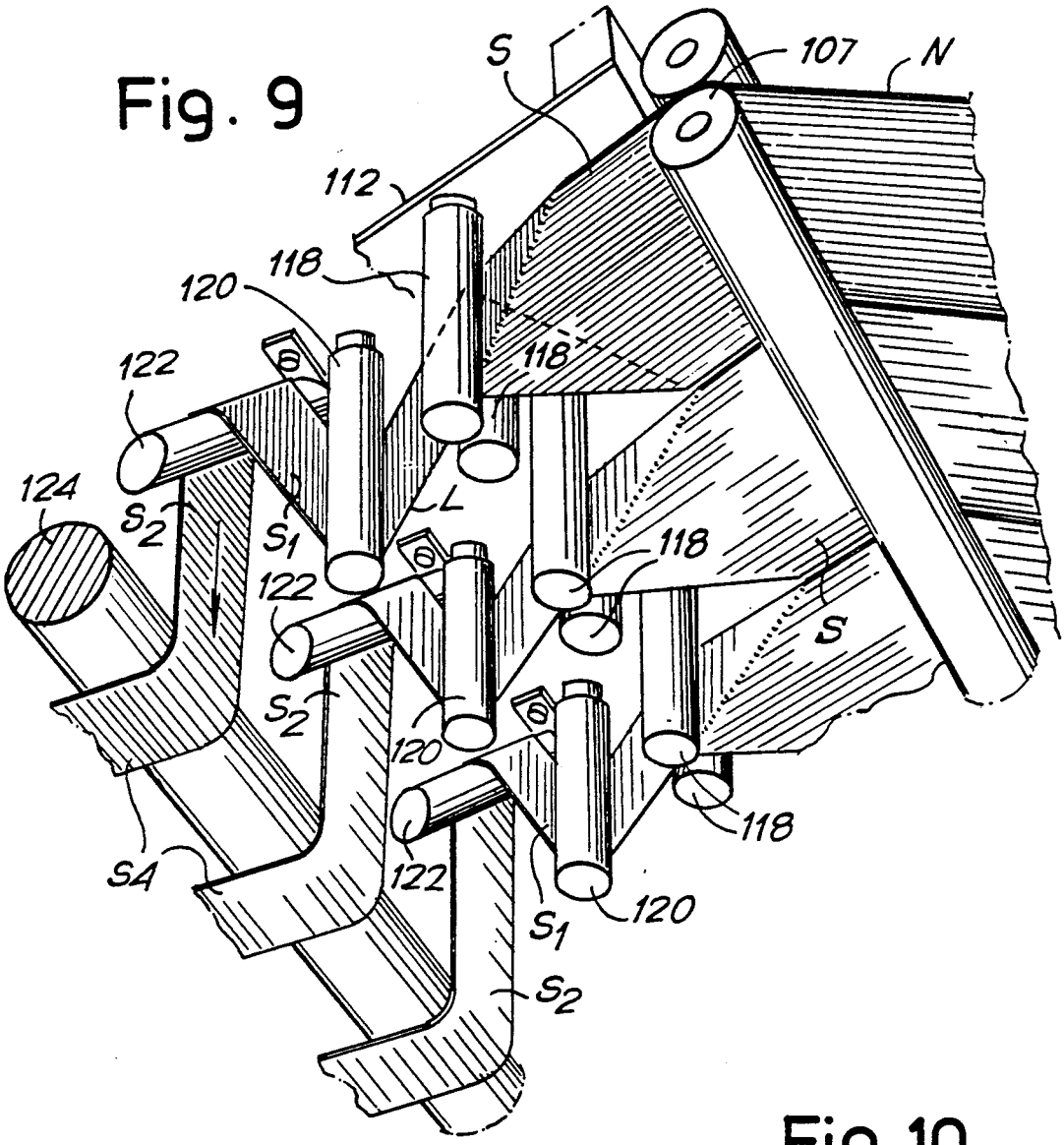
FIG. 9 shows a partial and schematic perspective view similar to FIG. 1 of the folder of FIG. 8.

FIGS. 8 to 10 show a modified embodiment of the apparatus according to the invention, the structure of which is even more compact, in order to further reduce the length of the working line. This modified embodiment also reduces the formation of wrinkles in the web between the longitudinal folding and transversal cutting zones of the apparatus.

FIG. 8 shows a schematic general view. Machine 101 is a preliminary work machine, which corresponds to machine 1 of FIG. 4, while 126 indicates a handling and stacking machine which coresponds to machine 26 of FIG. 4. The web N is fed into the direction of arrow fN to machine 101 for the longitudinal folding and cutting. Numeral 107 indicates a driving cylinder for web N and 109 indicates cutting means for longitudinally cutting web N in order to form a plurality of longitudinal strips S.

Strips S are guided by cylinder 107 onto an inclined surface defined by a plurality of triangle-shaped means 112, each of which corresponds to one of the strips S and is able, in a well-known manner, to determine the folding of the relevant strip S according to a longitudinal central folding line L which defines the two longitudinal edges of the strip to be matched. The inclination of triangles 112 may be adjusted by adjustment means 114 reacting on the assembly supporting structure 116. The same structure 116 supports, near the vertex of each one of triangles 112, a pair of driving rollers 118 which receive the folded edges of the relevant strip, so as to match them and press the folding line L.

In the illustrated example, a further driving roller 120 is provided downstream of each pair of driving rollers 118. This further roller 120 may, however, be omitted. In the drawing, the axes of rollers 118 and the axes of rollers 120 lie on two parallel and vertical planes, and the said rollers may be motorized or free-wheeling. As the axes of rollers 120 are coplanar, the folded strips S are moved into a common plane tangent to rollers 120 at a position opposite to that of rollers 118. The portions of the folded strips which are moved by the rollers 120 are indicated by S1 in the drawing. These portions S1 meet turning bars 122, parallel to each other and lying in a plane parallel to that of the axes of rollers 118 and of rollers 120.

The arrangement of the turning bars 122 is such that each of the folded strips is moved from the portion S1, having substantially horizontal development, up to a portion of trajectory S2 which is vertical and at a right angle to portion S1, as can be seen in FIG. 9.

The strips folded and moved in the above described manner reach a further driving roller 124 having horizontal axis, so that the various strips are further moved according to trajectory portions S4 lying in a substantially horizontal plane, to come out from machine 101 and reach another machine 126 for the handling of folded and coplanar strips S4 for the formation of packs or stacks of napkins or other products obtained from strips S4.

This machine will be described hereinafter.

The arrangement of rollers 118, 120 and of turning bars 122 may be modified in order to be placed according to an arrangement similar to that of FIGS. 5 or 6.

The machine 126 may be the same as the machine 26 of FIG. 4, or may be a machine of the kind described in patent EPA-O 302 031.

The machine 126 of FIG. 8 is similar to machine 26, but is modified in some repects. This modified machine 126 may be used also in combination with the machine 1 of FIGS. 1 to 4.

The machine 126, schematically shown in FIG. 8, is provided with a pair of folding and cutting cylinders 142, 144, which receive the strips S4 and which cut these strips in successive pieces of suitable length, for example, correpsonding to the width of strips S. The pieces of strip are continuously fed to a distribution group which comprises a pair of cylinders 146, 148 provided with opposite annular grooves within which the prongs of a comb 149, oscillating about a pivot 150, may ride for the purposes to be indicated below.

The pieces of strips S4, upon their transit between the group of cylinders 142, 144 and the cylinder 146, are transversely folded once so that when they reach the zone between cylinders 146 and 148, they are spaced apart one from the other an extent corresponding to half the length of the pieces into which the strips have been cut. By displacing the comb 149 from a position where the prongs are inserted into the grooves of cylinder 148 to an opposite position where the prongs are inserted into the grooves of cylinder 146, there is obtained a change of the flow of the folded pieces, that is to say, of the napkins, to one direction or the other as indicated by arrows f1 and f2, and towards packaging groups generally indicated by 152 and 154. The transfer of the napkins may take place by engagement of their longitudinal edges with pairs of belts having circular cross-section.

For each packaging group, two belts are provided disposed as shown schematically in FIG. 10. Around the cylinder 148, two belts 156, 158 are driven, one of which (158) is shown in FIG. 8. Each belt is driven around pulleys 159, 160, 161, 162 having horizontal axes and around pulleys 163, 165, 167, 169 having vertical axes, thereby the two branches 156A, 156B and 158A, 158B respectively of each belt 156, 158 will be parallel and disposed side-by-side to grip the edges of the folded napkins. The disposition schematically illustrated in FIG. 10 is symmetrically repeated for the two packaging groups 152, 154.

The napkins are transferred by the belts 156, 158 below the pushing pads 164 and 166, the lowering of which causes the napkins to withdraw from the side-by-side disposed branches 158A, 158B and 156A, 156B of belts 156, 158 of one or the other of groups 152, 154 respectively, in order to place them on a shelf 168 or 170 respectively. Each shelf 168 and 170 is progressively lowered with the increase of the thickness of pack P of napkins being stacked thereon. When a pack P has reached the desired thickness or the desired number of napkins, the comb 149 is moved from its position to change the napkins' flow towards the other packaging group. The completed pack of napkins is now fully lowered by a lowering of the relevant shelf. Under these conditions, the shelf 170 is at the level of a belt conveyor 174 (near the shelf 170) so that the napkins' pack P can be transferred by a pusher means 176 from shelf 170 to conveyor 174 which provides for the removal thereof from the stacking region. At this point, the shelf 170 may be lifted up to be ready to receive a new set of napkins forming a new pack of napkins.

In order to facilitate the withdrawal of each folded napkin held between the branches 156A, 156B and 158A 158B respectively, to each belt 156, 158 there is a further pulley 180, 182 respectively. Pulleys 180, 182 are eccentrically mounted on the horizontal axes and perform a full rotation of 360° for each lowering stroke of the relevant pushing pads 164, 166. As the pulleys 180, 182 are eccentrically mounted on their respective axes, their rotation in synchronism with the movement of the pushing pads 164, 166 causes a periodical moving away of the branches 156A, 156B and 158A, 158B. This moving away makes easier the withdrawal of the folded napkin and eliminates formation of wrinkles. The same arrangement may be used also in the machine of FIG. 4.

It is to be understood that the present invention may be embodied in other specific forms without departing from the spirit or special attributes hereof, and it is therefore desired that the present embodiments be considered in all respects as illustrative, and therefore not restrictive, reference being made to the appended Claims rather than to the foregoing description to indicate the scope of the invention.

Having thus described my invention, what I claim as new and desire to protect by Letters Patent are the following:

1. Apparatus for the production of paper napkins or other similar manufactured articles, including means for continuously feeding web material having undetermined length, folding means to longitudinally fold the web, transverse cutting means for cutting discrete pieces from the longitudinally folded web, means to fold said pieces transversely, and means to form successive stacks of manufactured articles from the folded pieces, said apparatus having:

longitudinal cutting means (9;109) for cutting the web into a plurality of longitudinal strips (S) lying in a feeding plane and moving in a feeding direction, said strips each having a width corresponding to one of the dimensions of the manufactured articles to be produced;

said folding means including a plurality of devices (12;112) for longitudinally folding the respective strip;

driving roller means (18,18,20; 118,118,120) downstream of said folding means (12;112) to align the two edges of the longitudinally folded strips; and inclined turning bars (22;122) downstream of said driving roller means (18, 18, 20; 118, 118, 120) to twist the longitudinally folded strips so that they lie on a common geometric plane intersecting the feeding plane along a line extending transversely to the feeding direction, with the directions of motion of the strips in parallel relationship to each other.

2. Apparatus according to claim 1, characterized in that said driving roller means include for each strip (S), two rollers (18, 18; 118, 118) disposed side-by-side and close to each other to receive and align the edges of the respective longitudinally folded strip.

3. Apparatus according to claim 2, characterized in that said driving roller means include, for each strip (S), a further driving roller (20; 120) having an axis parallel to the side-by-side disposed rollers (18, 18; 118, 118) and located downstream thereof with respect to the web feeding direction and upstream of the respective turning bar (22; 122); said further driving roller (20; 120) changing the trajectory of the respective strip so that the center line of the strip portion (S2) coming out from said turning bar (22; 122) will be coplanar to the center line of the strip (S) prior to the longitudinal folding.

4. Apparatus according to claim 2 or 3, characterized in that downstream of said driving roller means (18, 18, 20; 118, 118, 120) and of said turning bars (22; 122) roller means (24; 124) are provided having their common axis at a right angle to the axes of the driving rollers in order to lay the strips in said common geometric plane.

5. Apparatus according to claim 4, characterized in that said roller means (24; 124) having a common axis comprise a single roller (24; 124) across the width of the web work front.

6. Apparatus according to any of claims 1 to 3, characterized in that the driving roller means (18, 18, 20; 118, 118, 120) and the turning bars (22; 122) of each respective strip (S) are equidistant to each other.

7. Apparatus according to any of claims 1 to 3, characterized in that at least the turning bars (22; 122) and one driving roller (20; 120) located upstream of the respective turning bar (22; 122) are transversely offset in different extents, with respect to the advancing strips, in order to bring said folded strips (S4) close to each other in said geometric common plane where said strips are laid down in parallel relationship to each other.

8. Apparatus according to any of claims 1 or 2 or 3, characterized in that the folding means (112), the driving roller means (118, 118, 120) and the inclined turning bars (122) are placed above the transverse cutting means (26 etc.; 126 etc.) for cutting pieces of longitudinally folded web, the means to transversely fold said discrete pieces and the means for piling up successive stacks of manufactured articles.

9. Apparatus according to any of claims 1 or 2 or 3, characterized in that the turning bars (22, 122) are provided with holes or nozzles for an air jet which reduces the friction between the bars and the respective strips (S2) of web material.

10. Apparatus according to any of claims 1 or 2 or 3, characterized in that the means to stack the manufactured articles comprise at least a pair of parallel belts (156, 158) which are driven in such a way that each of them has two branches (156A, 156B; 158A, 158B) placed in side-by-side relationship, which hold two parallel edges of the folded manufactured article, means (180, 182) being provided for periodically spreading apart said branches (156A, 156B; 158A, 158B) in order to replace the manufactured article.

11. Method for the production of paper napkins or other similar manufactured articles, including cutting a web material of undefined length into longitudinal strips which move in a web feed direction and lie in a first plane, folding said strips longitudinally, feeding the longitudinally folded strips to means for transversely cutting and folding thereof, wherein the step of feeding the longitudinally folded strips includes twisting the longitudinally folded strips (S1) so as to cause them to extend parallel to each other and lie in a second plane which intersects the first plane along a straight line which is a right angle to the web feeding direction.

12. Method according to claim 11, characterized by moving the longitudinally folded strips (S1) transversely so that the center line of each strip will be coplanar to the center line of the strip (S) prior to the longitudinal folding.

13. Method according to claim 11, characterized by offsetting the longitudinally folded strips (S2) transversely to each other by varying amounts, so that the center lines of the longitudinally folded strips will be spaced apart from each other by an extent less than the distance of the center lines of strips (S) prior to the longitudinal folding thereof.

* * * * *

UNITED STATES PATENT AND TRADEMARK OFFICE

CERTIFICATE OF CORRECTION

PATENT NO. : 5,088,975

DATED : February 18, 1992

INVENTOR(S) : Mauro Ghilardi

It is certified that error appears in the above-identified patent and that said Letters Patent is hereby corrected as shown below:

Title page, item (73) Assignee: "Pablo Perini S.p.A." should read--Fabio Perini S.p.A.--.

Signed and Sealed this

Fifteenth Day of June, 1993

*Attest:*

Michael K. Kirk

MICHAEL K. KIRK

*Attesting Officer*

*Acting Commissioner of Patents and Trademarks*